United States Patent [19]

Røkholt

[11] 4,069,115

[45] Jan. 17, 1978

[54] METHOD AND ARRANGEMENT FOR REMOVING A GAS CUSHION

[75] Inventor: Jørgen Røkholt, Rykkinn, Norway

[73] Assignee: Maskin A/S K. Lund & Co., Oslo, Norway

[21] Appl. No.: 791,498

[22] Filed: Apr. 27, 1977

[51] Int. Cl.[2] ..... C25C 3/06

[52] U.S. Cl. ..... 204/67

[58] Field of Search ..... 204/67

[56] References Cited

U.S. PATENT DOCUMENTS

| | | | |
|---|---|---|---|
| 2,593,741 | 4/1952 | Ferrand | 204/67 |
| 3,551,308 | 12/1970 | Capitaine | 204/67 |

*Primary Examiner*—John H. Mack
*Assistant Examiner*—H. A. Feeley
*Attorney, Agent, or Firm*—J. Harold Nissen

[57] ABSTRACT

Method and arrangement for removing a gas cushion formed at the anode in an electrolytic cell for the production of aluminum by electrolysis of aluminum oxide dissolved in molten cryolite. There is employed a tubular lance which through a flexible hose is connected to a source of pressurized gas, and which is with its mouth adapted to be introduced towards the gas cushion in order to have this blown away. As the source of gas there is employed an exhaust gas system of a combustion engine located in a movable machine.

8 Claims, 2 Drawing Figures

METHOD AND ARRANGEMENT FOR REMOVING A GAS CUSHION

Figure 1:
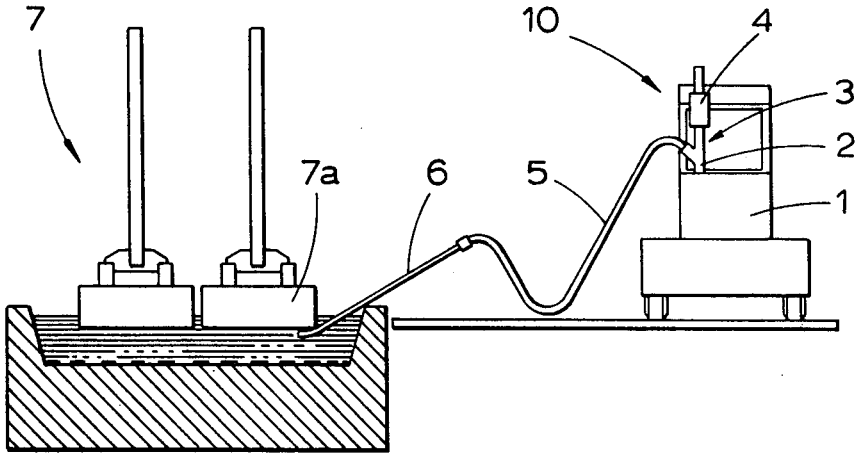

In the production of aluminum by electrolysis of $Al_2O_3$ dissolved in molten cryolite there is occurring at intervals a so-called anode effect. The anode effect is recognized by a very sharp voltage increase, whereby the voltage across the electrolytic cell increases from about 5 volts to 30–40 volts. Observations have shown that there is then formed a cushion of fluoride-containing gases underneath the anode and that electrical discharges take place across this gas cushion.

The cause of anode effect is usually that the concentration of $Al_2O_3$ in the molten electrolyte becomes too low. In order to bring the electrolytic cell back to normal production it is necessary to add $Al_2O_3$ to the electrolyte and to remove the gas cushion which has been formed underneath the anode.

$Al_2O_3$ is usually added thereby that the crust which has formed on the surface of the molten electrolyte, is broken and pressed down into the electrolyte, whereby it is molten or dissolved. This operation is carried out with a tool being suitable therefor, for example as described in U.S. Pat. No. 3,306,668. The tool is usually mounted on a carriage (called crust breaker) which is driven by a combustion engine.

The gas cushion underneath the anode is usually removed thereby that compressed air is introduced underneath the anode and in this manner the cushion is blown away. The compressed air is led underneath the anode through a suitable steel tube (lance) which through a flexible hose is connected to a conduit system for distribution of compressed air in the electrolysis hall.

Blowing with compressed air is an effective method, but it also has its drawbacks. In the first place there is a requirement for a widely branched compressed air plant which is expensive in installation, maintenance and operation. Moreover, air lances and hoses must be located at various places in the electrolysis halls, which leads to a large comsumption of expensive rubber hoses. There will also easily be confusion and traffic obstruction in the halls because of all this movable material. It also involves hazard possibilities that the hoses being of lengths from 10–30 meters are loose at one end while the compressed air flows therethrough. The hoses will then have a tendency to twist or throw themselves and thereby give off dangerous strokes. The system of distributing many air lances at various places in the electrolysis halls also leads to the situation that the individual air lances will not be under continuous control with respect to moisture.

As known it is an old precaution in electrolysis halls that no tool must be introduced into the cryolite melt or aluminum melt without being dry, preferably hot. A thin, unnoticeable dew layer on steel tools can result in mortal explosions when the tool is inserted into the melt. When an anode effect is to be removed quickly, it may be forgotten in the hurry to check that the air lance is warm and an explosion may take place.

The present invention has for its purpose to eliminate these problems by employing the exhaust gases from a combustion engine on the crust breaker or another machine available, instead of compressed air for blowing away the gas cushion.

Although it is highly preferred to utilize a crust breaking machine in this connection, there may also be other movable machines being used in electrolysis halls which can be utilized when removing the gas cushion in electrolytic cells. As an alternative there may be used a quite conventional tractor which has this as its sole function.

It is, moreover, preferred that the combustion engine which supplies the necessary exhaust gases for this blowing, is a diesel engine, since diesel engines have been found to be well suited for this purpose. It is an additional advantage that the combustion engine concerned is the drive motor for the movable machine.

The novel and particular features of the method and arrangement according to the invention are stated more closely in the claims.

Figure 2:
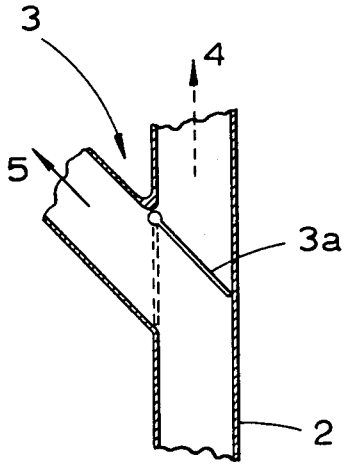

In the following description the invention shall be explained more in detail with reference to the drawing in which:

FIG. 1 shows in a simplified way a crust breaker with an arrangement for carrying out the method according to the invention, in operative position at an electrolytic cell, and FIG. 2 shows in enlargement a two-way valve in the arrangement of FIG. 1.

The exhaust gases from the combustion engine 1 of the crust breaker 10 are collected in the exhaust manifold 2 of the engine and are led therefrom to a two-way valve 3 which can direct the exhaust gases either through an exhaust silencer 4 out to the atmosphere, or to a flexible hose 5 with a lance in the form of a steel tube 6 under an anode *7a* in an electrolytic cell 7.

In FIG. 2 it is shown that the two-way valve 3 from below receives the exhaust gases from the exhaust manifold 2 and can direct these to the exhaust silencer 4 or the hose 5 respectively, by means of a valve element *3a* which in FIG. 2 is shown in such a position that the exhaust gases are directed into the hose 5.

In view of the fact that the equipment for removing anode effect is mounted at any time on the crust breaker, the operator saves the time which is usually taken for coupling the flexible hose to the dirtribution network for compressed air. This time-saving means that the operator can very quickly remove the gas cushion which has been formed at the anode and thereby also remove the anode effect. This has very large significance since the electrolytic cell produces little aluminum when it is in a condition of anode effect. On the other hand it will then produce undesired and polluting fluoride-containing gases at the same time as the cell becomes hotter because of the large energy consumption, which is also unfavourable to the production. Quick work when anode effect is removed, will therefore in other words increase the production, save energy and reduce the emission of polluting gases. Moreover, with this arrangement the consumption of compressed air, which is very expensive, for this purpose will be eliminated.

Finally, the safety will also be improved since the operator uses one and the same air lance, which thereby will be kept warm between each time it is used. It is an additional advantage that no hazardous rubber hoses will be lying on and striking against the floor in the hall and that there will be less confusion therein.

I claim:

1. Method of removing a gas cushion formed at the anode in an electrolytic cell for the production of aluminum by electrolysis of aluminum oxide dissolved in molten cryolite, in which there is employed a tubular lance (6) which through a flexible hose (5) is connected to a source of pressurized gas, and which is with its mouth adapted to be introduced into the gas cushion in order to have this blown away, comprising the step of:

applying the exhaust gas of a combustion engine as the source of pressurized gas into the gas cushion, and wherein the combustion engine is located in a movable machine.

2. Arrangement for carrying out the method according to claim 1, comprising a tubular lance (6) which through a flexible hose (5) is connected to a source of pressurized gas, wherein the flexible hose (5) is connected to the exhaust gas system (2) of a combustion engine (1) in a movable machine (10).

3. Arrangement according to claim 2, wherein the movable machine is a crust breaker (10).

4. Arrangement according to claim 2, wherein the combustion engine is a diesel engine (1).

5. Arrangement according to claim 2, wherein the combustion engine is the drive motor (1) of the movable machine (10).

6. Arrangement according to claim 2, wherein the exhaust manifold (2) of the engine there is mounted on a two-way valve (3) which serves to direct the exhaust gases either to the lance (6) through the flexible hose (5) or out to the atmosphere through an exhaust silencer (4).

7. Arrangement according to claim 2, wherein the movable machine is a crust breaker, and the combustion engine is the drive motor of the movable machine, said combustion engine being a diesel engine.

8. Arrangement according to claim 3, wherein the combustion engine is a diesel engine and is the drive motor of the movable machine.

* * * * *